US008458837B2

(12) United States Patent
Marcangelo et al.

(10) Patent No.: US 8,458,837 B2
(45) **Date of Patent: *Jun. 11, 2013**

(54) METHODS FOR MANUFACTURING A SELF-FORMING MATTRESS COVER

(75) Inventors: Steven Marcangelo, Londonderry, NH (US); Steve Wall, Browns Summit, NC (US); Justin R. Bloyd, Greensboro, NC (US)

(73) Assignee: L & P Property Management Company, South Gate, CA (US)

( * ) Notice: Subject to any disclaimer, the term of this patent is extended or adjusted under 35 U.S.C. 154(b) by 137 days.

This patent is subject to a terminal disclaimer.

(21) Appl. No.: 13/025,324

(22) Filed: Feb. 11, 2011

(65) Prior Publication Data

US 2011/0131724 A1 Jun. 9, 2011

Related U.S. Application Data

(63) Continuation-in-part of application No. 12/431,174, filed on Apr. 28, 2009, now Pat. No. 8,074,313.

(51) Int. Cl.
*A47C 31/02* (2006.01)

(52) U.S. Cl.
USPC ..... 5/737; 5/691; 5/690

(58) Field of Classification Search
USPC ..... 5/737, 738, 690, 691, 498–501, 482, 5/698, 483, 954
See application file for complete search history.

(56) References Cited

U.S. PATENT DOCUMENTS 2,975,437 A 3/1961 Freeman
4,463,466 A 8/1984 May et al.
5,475,881 A 12/1995 Higgins et al.
5,586,511 A 12/1996 Porter et al.
5,655,241 A 8/1997 Higgins
6,088,858 A 7/2000 Juster et al.
6,263,532 B1 7/2001 Miller
6,574,815 B2 6/2003 Freeman et al.
6,721,982 B2 4/2004 Freeman
6,834,603 B1 12/2004 Price et al.
6,954,956 B1 10/2005 Diaz
6,988,286 B2 1/2006 Schecter
6,994,043 B1 2/2006 Price
7,150,059 B2 12/2006 Small, Jr. et al.

(Continued)

OTHER PUBLICATIONS

Notice of Allowance and Fee(s) Due, U.S. Appl. No. 12/431,174, mailed: Sep. 28, 2011.

*Primary Examiner* — Robert G Santos
(74) *Attorney, Agent, or Firm* — Shook Hardy & Bacon LLP

(57) ABSTRACT

A self-forming mattress cover including a mattress gusset with a drawstring is provided. The gusset includes a sleeve attached to the gusset along a fold location. A drawstring is disposed within the sleeve. Ends of the drawstring are pulled into tension, thereby reducing the perimeter of the gusset at the fold location and drawing the gusset inward toward the center of the mattress. The gusset is formed to corner positions of the mattress by stretching and/or bunching of gusset material as tension is applied. The ends of the drawstring are secured to retain the tension state. A cushioned quilt top is attached to a free edge of the gusset. The self-forming mattress cover conforms to corner positions of a mattress without the need for mitering, ruffling, pleating, or sewing seams at the corner positions. The self-forming mattress cover also ensures proper alignment of the cushioned quilt with the mattress body.

18 Claims, 5 Drawing Sheets

U.S. PATENT DOCUMENTS

| | | | | |
|---|---|---|---|---|
| 7,181,794 | B2 | 2/2007 | Diaz | |
| 7,225,487 | B2 | 6/2007 | Small, Jr. et al. | |
| 7,412,936 | B2 | 8/2008 | Price et al. | |
| 7,421,750 | B2 | 9/2008 | Knoff | |
| 7,644,671 | B2 | 1/2010 | Smith et al. | |
| 8,074,313 | B2 * | 12/2011 | Marcangelo | 5/737 |
| 2002/0144352 | A1 | 10/2002 | Freeman et al. | |
| 2002/0166175 | A1 | 11/2002 | An | |
| 2003/0177583 | A1 | 9/2003 | Freeman | |
| 2004/0019972 | A1 | 2/2004 | Schecter | |
| 2004/0226100 | A1 * | 11/2004 | Small et al. | 5/698 |
| 2005/0183202 | A1 | 8/2005 | Diaz | |
| 2005/0227558 | A1 | 10/2005 | Small et al. | |
| 2007/0094802 | A1 | 5/2007 | Knoff | |
| 2007/0094804 | A1 | 5/2007 | Knoff | |
| 2008/0201859 | A1 * | 8/2008 | Smith et al. | 5/716 |
| 2009/0070940 | A1 | 3/2009 | Knoff | |
| 2010/0269743 | A1 | 10/2010 | Marcangelo | |
| 2011/0072591 | A1 | 3/2011 | Fang | |
| 2011/0131724 | A1 | 6/2011 | Marcangelo et al. | |

* cited by examiner

METHODS FOR MANUFACTURING A SELF-FORMING MATTRESS COVER

CROSS-REFERENCE TO RELATED APPLICATIONS

This application is a continuation-in-part of U.S. patent application Ser. No. 12/431,174, filed Apr. 28, 2009 (now U.S. Pat. No. 8,074,313) the disclosure of which is hereby incorporated herein, in its entirety, by reference.

BACKGROUND

In the bedding industry, mattresses commonly have a cushioned quilt, such as a pillow-top, Euro-top, or box-top attached to a top portion of the mattress. The cushioned quilt provides additional padding and comfort to a user over that provided by the internal layers and core system of the mattress. Typically the cushioned quilt and mattress are assembled to provide the appearance that the cushioned quilt is a separate component lying on top of the mattress body.

Attachment of the cushioned quilt to the mattress body is commonly completed through the use of a section of folded material called a gusset that connects along the perimeter of the mattress border and along the perimeter of the cushioned quilt. To negotiate the four corner positions of the mattress the gusset has historically required one or more processes of mitering, pleating, ruffling, and adding seams to the material. Such processes add to the complexity, time, and expense of manufacturing operations.

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

Embodiments of the invention provide a gusset with a drawstring for attaching a cushioned quilt to a mattress. The gusset conforms to corner positions of the mattress without mitering, pleating, or ruffling and ensures proper alignment between the mattress and the cushioned quilt. The gusset includes a sleeve attached along a fold location extending the length of the gusset and bisecting the gusset into a first portion and a second portion. A drawstring is disposed within the sleeve and has a pair of ends extending from respective open ends of the sleeve. The first portion of the gusset is attached along a first edge to a border of the mattress. The pair of ends of the drawstring is pulled to reduce the perimeter of the gusset at the fold location and to draw the fold location of the gusset toward the center of the mattress and away from the border. The pair of ends is secured to maintain tension on the drawstring and the second portion of the gusset is folded over the first portion at the fold location toward the border of the mattress. The cushioned quilt is attached to a second edge along the second portion of the gusset.

BRIEF DESCRIPTION OF THE SEVERAL VIEWS OF THE DRAWINGS

Illustrative embodiments of the invention are described in detail below with reference to the attached drawing figures, and wherein.

DETAILED DESCRIPTION

Figure 1:
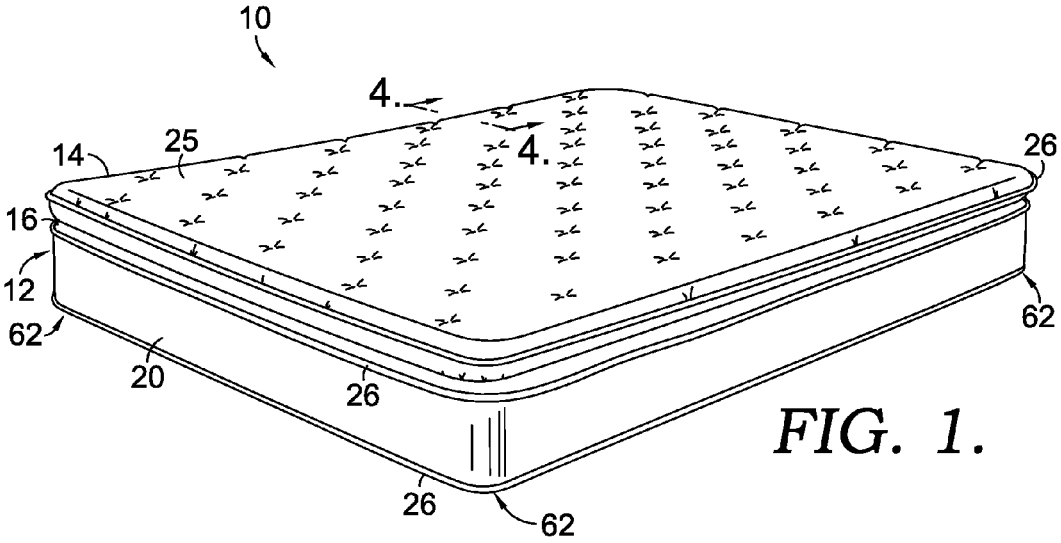
FIG. 1 is a perspective view of a mattress constructed with a self-forming mattress cover in accordance with embodiments of the invention.
Figure 2:
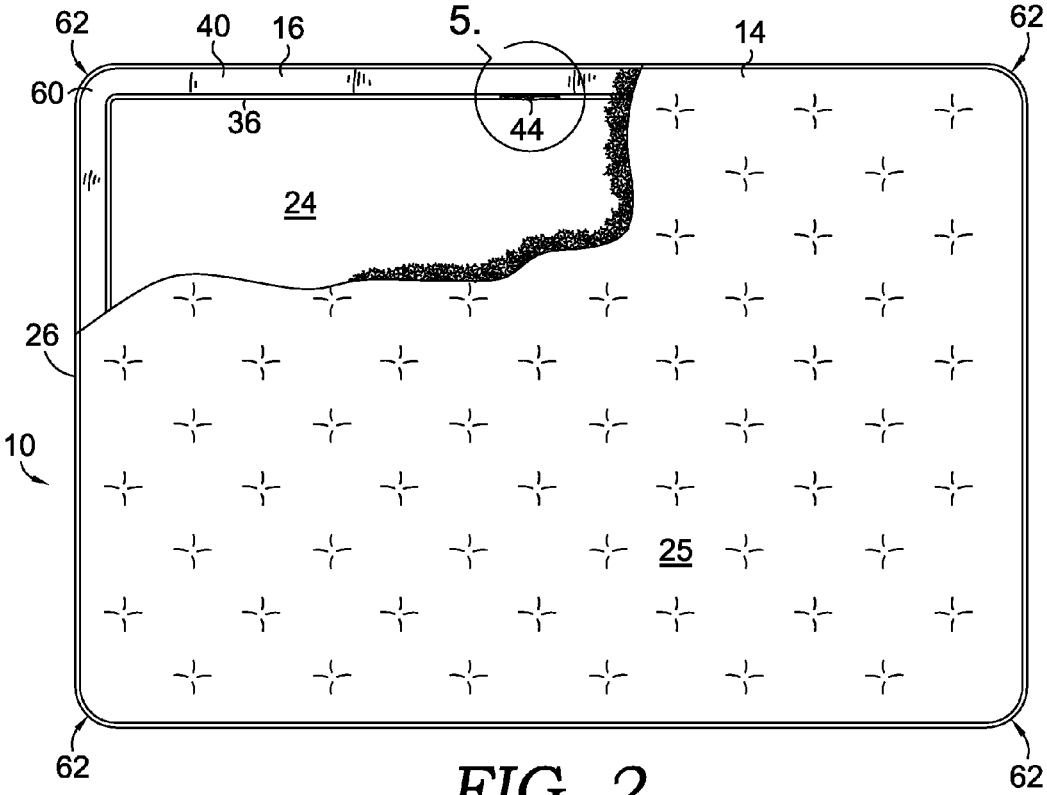
FIG. 2 is a top plan view of a mattress having a cutaway of a cushioned quilt and depicting a self-forming mattress cover having a gusset with a drawstring in accordance with embodiments of the invention.

The subject matter of embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

In one embodiment of the invention, a method for manufacturing a self-forming mattress cover is described. A cushioned quilt is attached to a mattress using a gusset with a drawstring. The gusset conforms to corner positions of the mattress and ensures proper alignment between the mattress and the cushioned quilt. A first edge of the gusset is attached to a mattress border. The gusset includes a fold location bisecting the length of the gusset into a first portion having a first edge and a second portion having a second edge. A sleeve is attached to the gusset along the fold location and has sufficient length to impart opposing open ends of the sleeve. A drawstring is slideably disposed within the sleeve and has a pair of ends extending respectively from the opposing open ends of the sleeve. Tension is induced in the drawstring via the pair of ends of the drawstring. Thereby the fold location of the gusset is drawn inward away from the mattress border. The pair of ends of the drawstring is secured to maintain tension. The gusset is folded at the fold location such that the second portion lies above the first portion. The cushioned quilt is attached to the gusset along the second edge.

In another embodiment, a self-forming mattress cover including a mattress gusset with a drawstring for attaching a cushioned quilt to a mattress is described. The mattress gusset conforms to corner positions of the mattress and ensures proper alignment between the mattress and the cushioned quilt. The mattress gusset includes a first edge for attaching to a border of the mattress cover and a second edge for attaching to a cushioned quilt. The border forms an exterior surface enclosing four sides of the mattress. The mattress gusset also includes a fold location bisecting the gusset along its length into a first portion and a second portion. The first portion includes the first edge and the second portion includes the second edge. A sleeve is attached along the fold location on an interior surface of the mattress gusset and has sufficient length to impart opposing open ends thereof. The sleeve includes an internal, coaxial passage sufficient to receive a drawstring. A drawstring is slideably disposed within the passage of the sleeve and a first and second end of the drawstring extend from respective opposing open ends of the sleeve a sufficient distance to allow the first and second ends of the drawstring to be pulled in tension and coupled together.

In yet another embodiment, a method for manufacturing a self-forming mattress cover is described. A cushioned quilt is attached to a mattress using a gusset with a drawstring. The gusset conforms to corner positions of the mattress and ensures proper alignment between the mattress and the cushioned quilt. The gusset is provided integral with the mattress cover. The mattress cover includes a border and a base. The border forms an exterior surface enclosing four sides of the mattress and is attached along a first edge to the base. The base forms an exterior surface enclosing a bottom of the mattress. The gusset extends from the mattress border and away from the bottom of the mattress. The gusset includes a fold location bisecting the length of the gusset into a first portion integrating with the mattress border along a boundary, and a second portion having a free second edge. A sleeve is attached to the gusset along the fold location and has sufficient length to impart opposing open ends of the sleeve. A drawstring is slideably disposed within the sleeve and has a pair of ends extending respectively from the opposing open ends of the sleeve. Tension is induced in the drawstring via the pair of ends of the drawstring, thereby drawing the fold location of the gusset inward away from the four sides of the mattress. The pair of ends of the drawstring is secured to maintain tension. The gusset is folded along the fold location such that the second portion lies above the first portion. A cushioned quilt is attached to the gusset along the free second edge.

Embodiments of the invention are suitable for use with any mattress technology available in the art that incorporates a cushioned quilt into the top, and/or bottom of a mattress body. Embodiments of the invention are described herein with respect to a spring core, or innerspring mattress, but such is not intended to limit the invention only to applications with spring core mattresses. Other mattress technologies include, for example and not limitation, air mattresses and foam mattresses. Spring core mattresses may include any spring coil system, such as for example Bonnell coils, Marshall coils, offset coils, and continuous coils, among others.

Further, any desirable construction of the mattress body (e.g., all of the components comprising the mattress except for the gusset and cushioned quilt) may be employed. One or more layers of material, foam, or upholstery might be used to insulate a user from the mattress core (springs) and to provide additional comfort. Such materials might include fibers, mesh, foam, viscoelastic foam, felt, polyester, and cotton, among others.

In addition, many methods are known in the art to attach sections of materials together. Such methods include sewing, stitching, bonding via adhesives, and fastening, among others. Any such methods are suitable for use in embodiments of the invention without departing from the scope thereof. Embodiments of the invention described herein utilize sewing methods to attach materials together, but such description is not intended to limit the scope of this description thereto unless explicitly specified otherwise. Further, one or more additional materials may be used to reinforce attachments and materials such as, for example and not limitation, backing material, piping, and tape, among others. All such materials are useable in embodiments of the invention without departing from the scope thereof.

Figure 3:
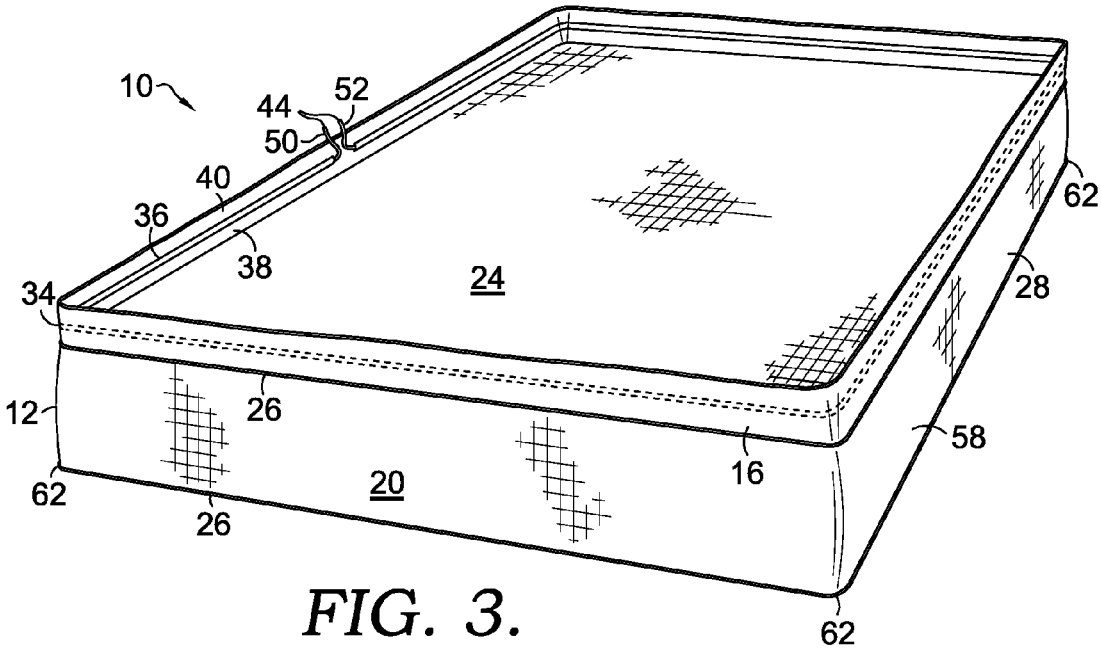
FIG. 3 is a perspective view of a self-forming mattress cover having a gusset with a drawstring prior to pulling the drawstring into tension in accordance with embodiments of the invention.
Figure 4:
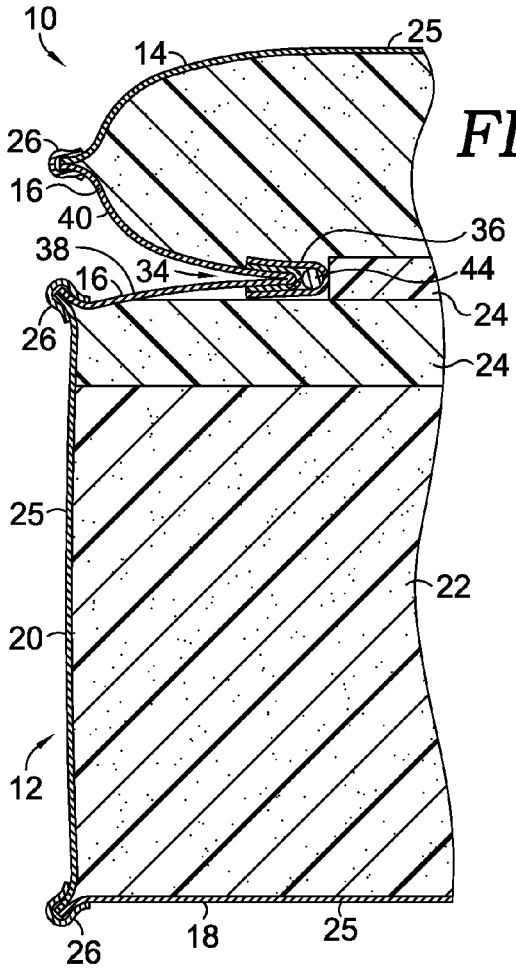
FIG. 4 is an enlarged, partial cross-sectional side elevation at line 4-4 of FIG. 1 of a mattress having a self-forming mattress cover including a gusset with a drawstring in accordance with embodiments of the invention.

With reference to FIGS. 1-8, wherein like reference numerals indicate like elements, a self-forming mattress cover including a mattress gusset with a drawstring is described in accordance with embodiments of the invention. As depicted in FIG. 4, a mattress 10 includes a mattress body 12, a cushioned quilt 14, and a gusset 16. The mattress body 12 further includes a base 18, a border 20, a core 22, and one or more material layers 24. The base 18 is the bottom surface of the mattress 10 on which the mattress 10 rests when in use. The base 18 may be covered by ticking 25 or may be covered by any other available material, such as for example a non-slip material to aid in restricting movement of the mattress 10 with respect to a box-spring or other support platform on which the mattress 10 rests. Ticking 28 provides the exterior surface for the majority of the mattress and may provide aesthetically pleasing colors and patterns. Ticking 28 may be made from any desirable material including polyester, acrylic, latex, cotton, silk, and wool, among others. In another embodiment, the mattress 10 is a double sided mattress and therefore the base 18 minors the cushioned quilt 14, the gusset 16, and any other associated components as are described below.

The border 20 forms an exterior surface enclosing the four sides of the mattress 10. The border 20 extends from the perimeter of the base 18 to the gusset 16. The border 20 is constructed from any available material as described above such as for example ticking 25, and may include one or more sections of piping 26 located at the boundaries of the border 20. Piping 26 may be used to enclose seams between the border 20, base 18, and gusset 16 to provide an aesthetically pleasing appearance as well as to reinforce such seams. In embodiments, one or more handles (not shown), vents (not shown), or other components might also be included within the border 20.

The core 22 contains the support structure of the mattress 10. As described above, the core 22 may utilize any available core system including coil springs, air bladders, and foam pads, among others. The material layers 24 lie on top of the core 22 to insulate a user from feeling pressure points caused by springs or other features of the core 22 and to provide additional cushion and comfort features to a user. As described above, the material layers 24 include any desired materials, foams, and upholsteries.

The cushioned quilt 14 (hereinafter "quilt") uses any form, materials, or construction compatible with the gusset 16. The quilt 14 includes, for example and not limitation, a pillow-top, a box-top, or a Euro-top as are known in the art. Cushioned quilts in the art commonly include one or more layers of foam or other padding materials that are quilted to the underside of a topmost surface layer of material such as the ticking 28.

The gusset 16 couples the quilt 14 to the mattress 10. The gusset 16 is attached on a first edge 30 to the border 20 and on a second edge 32 to the quilt 14. The attachments between the gusset 16 and the border 20 and quilt 14 are provided by stitching, sewing, or any other available method. In an embodiment, the gusset 16 is integral with the border 20, in that the gusset 16 and the border 20 are constructed from a single continuous piece of material. Piping 26 is included along seams created by the attachments to provide a finished, aesthetically pleasing appearance and/or for reinforcement.

Figure 6:
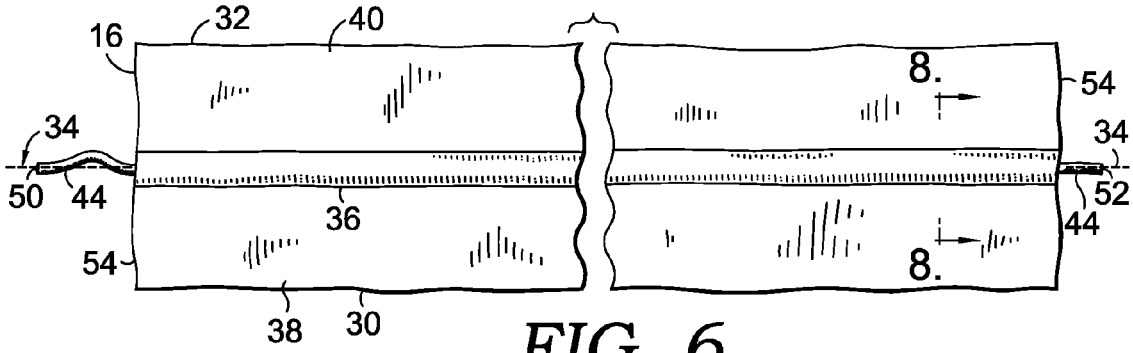
FIG. 6 is a plan view of a gusset with a drawstring in accordance with embodiments of the invention.

A fold location 34 is designated by attaching a sleeve 36 along the length of the gusset 16, as best depicted by FIG. 6. The fold location 34 bisects the gusset into a first portion 38 and a second portion 40. The fold location is generally centrally located along the width of the gusset 16, but may be offset to accommodate various designs and applications.

Figure 8:
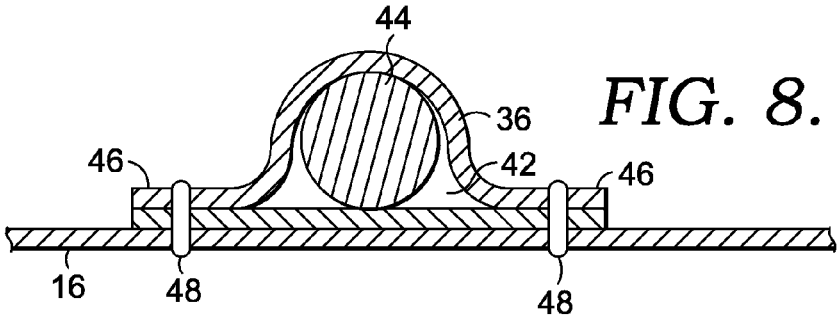
FIG. 8 is a cross-sectional view along line 8-8 of FIG. 6 of a gusset with a drawstring in accordance with embodiments of the invention.

The sleeve 36 extends nearly the full length of the gusset 16. In an embodiment the sleeve 36 extends the full length of the gusset 16. As shown in FIG. 8, a coaxial passage 42 suitable for receiving a drawstring 44 is included within the sleeve 16. The passage 42 is open at each end of the sleeve 36. Alternatively, the passage 42 may terminate at each end of the sleeve 36 and an orifice (not shown) may be provided near each end of the sleeve 36. The sleeve 36 is manufactured from any suitable material sufficient to withstand the forces applied when tension is applied to the drawstring 44 and during use of the mattress 10.

In an embodiment, the sleeve 36 is constructed from a single piece of material folded on itself along the length of the material and sewn along the mating edges (not shown) to form a cylindrical tube of material. Opposing sides of the cylindrical tube are compressed together to form flanges 46 and the passage 42. The sleeve 36 is attached to the gusset 16 by sewing along the flanges 46, as depicted by stitching 48 in FIG. 8. Alternatively, or in addition the sleeve 36 may be attached to the gusset 16 by adhesives, glues, or other bonding materials. Many variations for constructing the sleeve 36 are available in the art and are suitable for use in implementations of the invention without departing from the scope thereof.

The drawstring 44 comprises any string, rope, cord, wire, monofilament, or elastic sufficient to fit within the passage 42 and to withstand tension forces placed on the drawstring 44 during construction and use of the mattress 10. In an embodiment, the drawstring 44 comprises an elastomeric monofilament, such as CINCH-LOC from Matrex, a division of Leggett & Platt, Incorporated. In another embodiment, the drawstring 44 includes one or more elastomeric monofilaments braided into the drawstring 44 along with one or more other elastics, monofilaments, strings, ropes, cords, wires, or other materials. The materials selected for the drawstring 44 may be configured to prevent creep in the drawstring 44, stabilize tension forces in the drawstring 44, and to provide a memory to the drawstring 44 or gusset 16 that aids in maintaining a desired configuration. The drawstring 44 has a length sufficient to provide a first end 50 and a second end 52 extending from respective ends of the sleeve 36.

Figure 7:
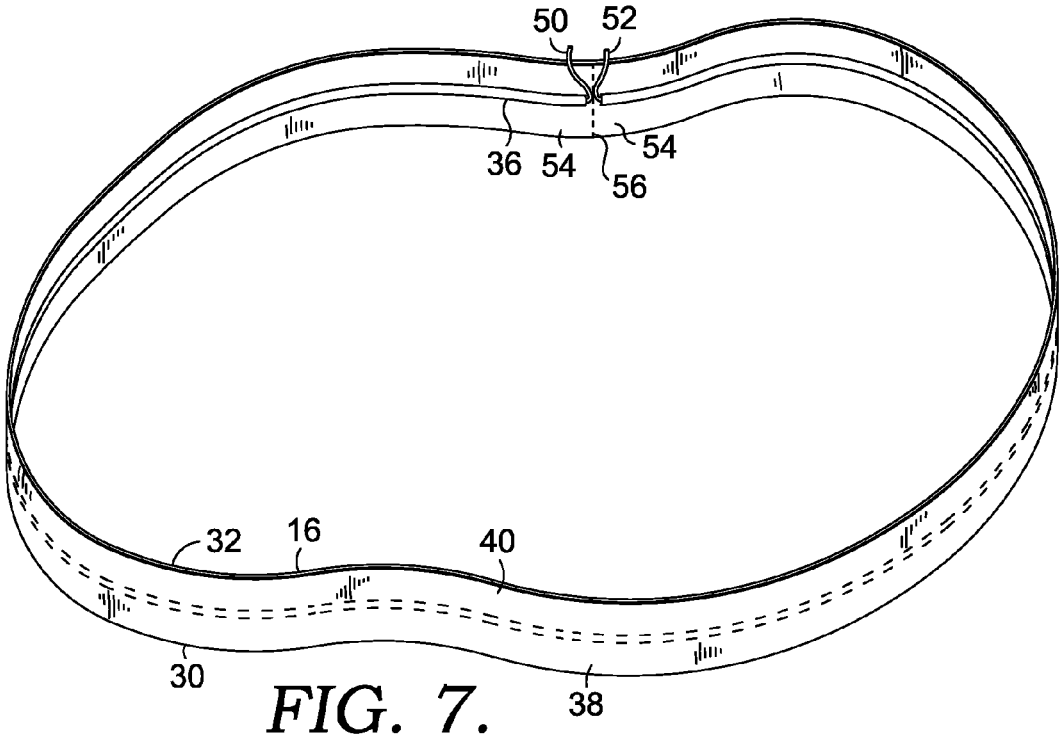
FIG. 7 is a perspective view of a gusset with a drawstring in accordance with embodiments of the invention.

With continued reference to FIGS. 1-8, the construction of the mattress 10 using a self-forming mattress cover having a gusset 16 with the drawstring 44 is described according to embodiments of the invention. Many variations in the sequence of steps for constructing the mattress 10 are possible which do not depart from the scope of the invention. One such sequence is described herein for illustrative purposes only. Initially, it is assumed that the appropriate materials are cut to size and length. The sleeve 36 is sewn to the gusset 16 and the drawstring 44 is inserted therein, as depicted in FIG. 6. The ends 54 of the gusset 16 are mated together and sewn in place along a seam 56 to form a continuous ring of material, as depicted in FIG. 7. By mating the ends 54 of the gusset 16 together the open ends of the passage 42 are positioned such that they oppose one another and the first and second ends 50, 52 of the drawstring 44 are place in close proximity to one another.

The gusset 16 is attached to the border 20 of the mattress 10 by sewing along the first edge 30 of the gusset 16. In an alternative embodiment, the gusset 16 and border 20 are sewn together prior to sewing the ends 54 of the gusset 16 together. The border 20 is also sewn to the base 18 along the perimeter of the base 18. One or more sections of piping 26 are sewn to the base 18, border 20 and gusset 16 to reinforce the seams therebetween. The core 22 and any material layers 24 are inserted into a self-forming mattress cover 58 comprised of the base 18, border 20, and gusset 16 as depicted in FIG. 3.

The first and second ends 50, 52 are pulled either manually by hand, or by a machine or device configured to pull the first and second ends 50, 52 of drawstring 44 from the sleeve 36 to induce tension therein. As the drawstring 44 is pulled the perimeter of the gusset 16 at the fold location 34 is decreased or drawn inward toward the center of the mattress 10 and away from the border 20. Additionally, the gusset 16 may stretch and/or bunch together around corner positions 60 of the mattress 10 in order to conform to the mattress corners 62. Further, as the drawstring 44 is pulled the first portion 38 of the gusset 16 is moved from a generally vertical position to a generally horizontal position resting on top of the material layers 24. As such, the mattress cover 58 self-forms to the mattress via the gusset 16.

Figure 5:
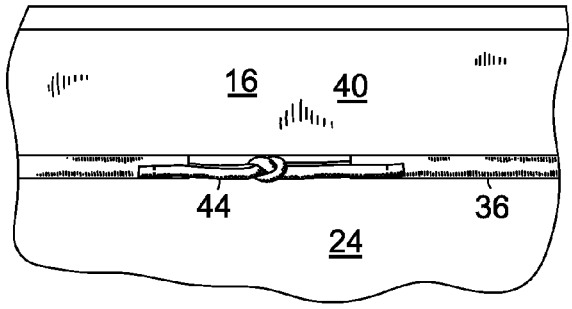
FIG. 5 is an enlarged view at section 5 of FIG. 2 of a drawstring of a self-forming mattress cover having a gusset with a drawstring in accordance with embodiments of the invention.

Upon reaching a desired tension and/or a desired reduction in the perimeter of the gusset 16 along the fold location 34, the first and second ends 50, 52 of the drawstring 44 are secured in position by tying together and are sewn to the sleeve 36, as depicted in FIG. 5. Various methods of securing the first and second ends 50, 52 of the drawstring 44 are known and are suitable for use in embodiments of the invention without departing from the scope thereof. Such methods include, for example and not limitation, clamping, fastening, and bonding with an adhesive, the first and second ends 50, 52 together and/or to the sleeve 36 or gusset 16.

The second portion 40 of the gusset 16 is folded over the first portion 38 along the fold location 34 such that the second portion 40 generally lies on top of the first portion 38. A pre-assembled quilt 14 is attached to the second portion 40 of the gusset 16 along the second edge 32, as depicted in FIG. 4. Piping 26 may also be sewn along the seam between the gusset 16 and the quilt 14 to provide a finished and aesthetically pleasing appearance as well as to reinforce the seam.

Accordingly, the quilt 14 is attached to the mattress 10 via the gusset 16 without the need for any mitering, pleating, ruffling, cutting, notching, or additional sewing operations. Further, there is no risk of misalignment of the gusset 16 with either the mattress 10 or the quilt 16. Where mitering or other operations listed above are employed, the gusset must be properly aligned with both the mattress and the quilt such that the miters, pleats, ruffles, etc. are properly positioned at the corner positions of the mattress. If such a gusset is not properly aligned the corners of the quilt will be skewed or will appear out of position and will not properly align with the mattress. In contrast, the gusset 16 of the self-forming mattress cover 58 of embodiments of the invention is a uniform section of material that self-forms and does not require any certain positioning or alignment. Thus, no matter the orientation or alignment of the gusset 16 with the mattress 10 or the quilt 14, the alignment and skewing problems of the above listed methods are not encountered.

Figure 9:
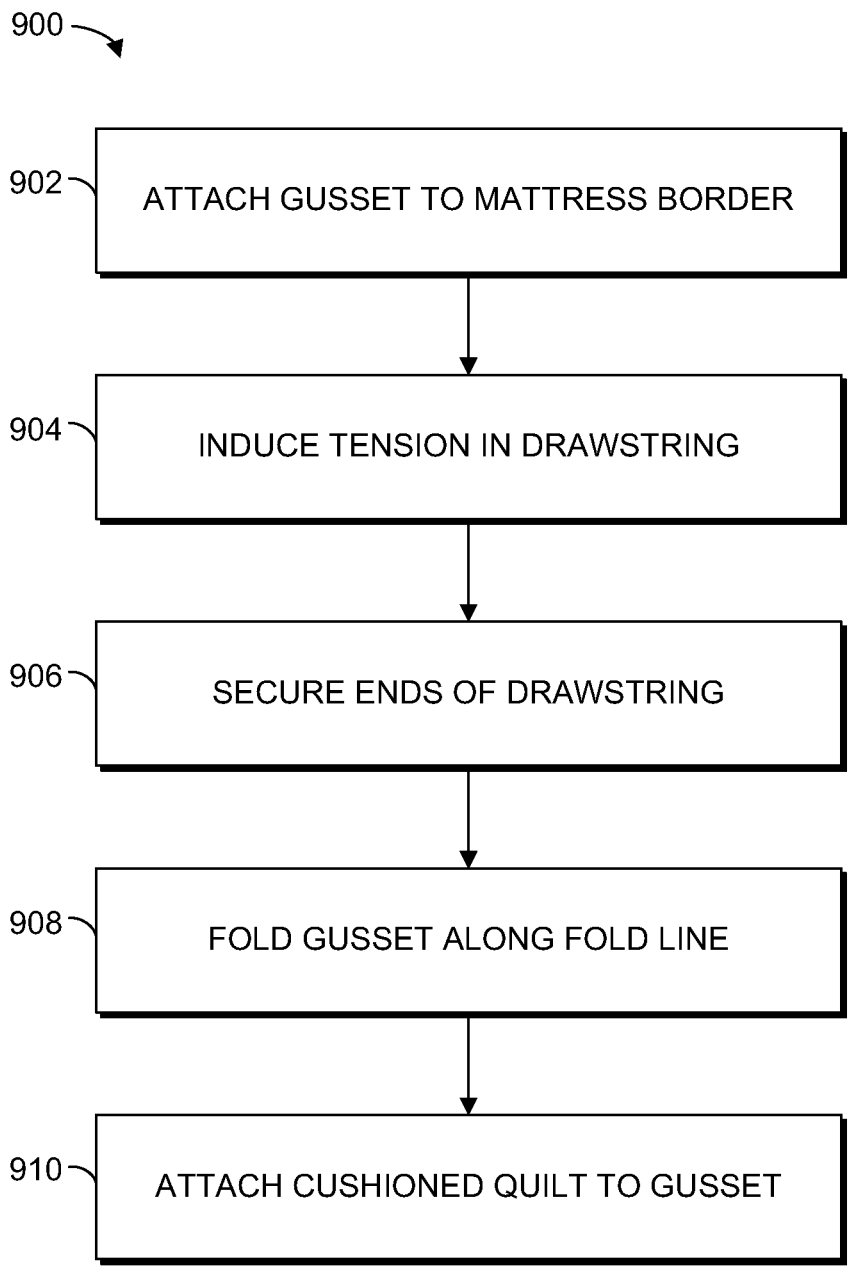
FIG. 9 is a flow diagram depicting a method for manufacturing a self-forming mattress cover in accordance with embodiments of the invention.

With reference now to FIG. 9, a method 900 for manufacturing a self-forming mattress cover is described in accordance with an embodiment of the invention. A gusset is attached to a mattress border, as indicated at 902. The gusset includes a sleeve attached along a fold location of the gusset, and the sleeve contains a drawstring disposed therein, as described above. The ends of the drawstring are pulled manually and/or mechanically to induce tension in the drawstring and to draw the gusset toward the center of the mattress, as indicated at 904. The ends of the drawstring are secured to retain the tension therein, at 906. The gusset is folded outwardly along the fold location as indicated by 908. At 910, a cushioned quilt is attached to a free edge of the gusset.

Figure 10:
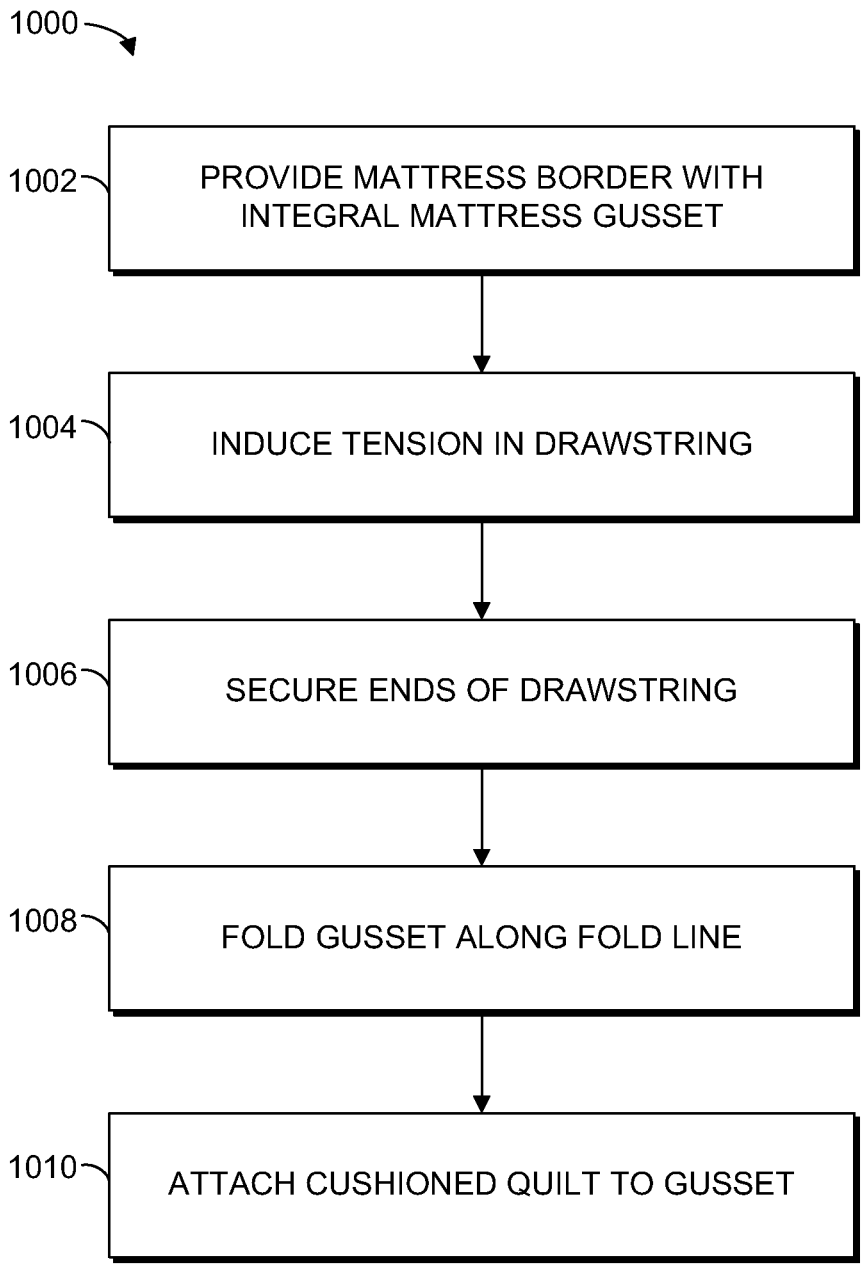
FIG. 10 is a flow diagram depicting a method for manufacturing a self-forming mattress cover in accordance with embodiments of the invention.

Referring now to FIG. 10, a method 1000 for manufacturing a self-forming mattress cover in accordance with another embodiment of the invention. An integrated mattress border and gusset are provided, as indicated at 1002. The mattress border is attached to a base of the mattress by sewing. A sleeve having a drawstring disposed therein is attached to the gusset along a fold location. The interior components of the mattress are inserted within the border and base and the drawstring of the gusset is pulled into tension to draw the gusset toward the center of the mattress, as indicated at 1004. At 1006, the ends of the drawstring are secured to maintain the tension by tying the ends together and sewing the ends to the sleeve. At 1008, the gusset is folded outwardly toward the border at the fold location. A pre-assembled quilt, such as a pillow-top, box-top, or Euro-top, is attached to a free edge of the gusset, as indicated at 1010.

In another embodiment, the quilt is attached to the gusset prior to tensioning the drawstring. In such an embodiment, the drawstrings may protrude through the gusset to be accessible from a position exterior to the mattress or the quilt may be only partially attached to allow access to the drawstring. In yet another embodiment, the drawstring is attached to an exterior surface of the gusset to provide access thereto from positions exterior to the gusset and mattress.

Many different arrangements of the various components depicted, as well as components not shown, are possible without departing from the scope of the claims below. Embodiments of our technology have been described with the intent to be illustrative rather than restrictive. Alternative embodiments will become apparent readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A method for manufacturing a self-forming mattress cover, wherein a cushioned quilt is attached to a mattress using a gusset with a drawstring, and wherein the gusset conforms to corner positions of the mattress and ensures proper alignment between the mattress and the cushioned quilt, the method comprising:

providing the gusset integral with the mattress cover, wherein the mattress cover includes a border and a base, the border forms an exterior surface enclosing four sides of the mattress and is attached along a first edge to the base, and the base forms an exterior surface enclosing a bottom of the mattress, wherein the gusset extends from the mattress border and away from the bottom of the mattress, the gusset including, a fold location bisecting the length of the gusset into a first portion integrating with the mattress border along a boundary, and a second portion having a free second edge, a sleeve attached to the gusset along the fold location and having sufficient length to impart opposing open ends of the sleeve, and a drawstring slideably disposed within the sleeve and having a pair of ends extending respectively from the opposing open ends of the sleeve, the drawstring including one or more of a string, a rope, a cord, a wire, a monofilament, elastic, or elastomeric monofilament;

inducing tension in the drawstring via the pair of ends of the drawstring, thereby drawing the fold location of the gusset inward away from the four sides of the mattress;

securing the pair of ends of the drawstring to maintain tension;

folding the gusset at the fold location such that the second portion lies above the first portion;

attaching a cushioned quilt to the gusset along the free second edge.

2. The method of claim 1, wherein the gusset stretches to conform to corner positions of the mattress.

3. The method of claim 1, wherein no ruffles, miters, pleats, or seams are necessary to conform the gusset to the corner positions.

4. The method of claim 1, wherein the gusset bunches at corner positions of the mattress when the drawstring is tensioned.

5. A self-forming mattress cover including a mattress gusset with a drawstring for attaching a cushioned quilt to a mattress, wherein the mattress gusset conforms to corner positions of the mattress and ensures proper alignment between the mattress and the cushioned quilt, the mattress gusset comprising:

a first edge for attaching to a border of the mattress cover, wherein the border forms an exterior surface enclosing four sides of the mattress;

a second edge for attaching to the cushioned quilt;

a fold location bisecting the gusset along its length into a first portion and a second portion, wherein the first portion includes the first edge and the second portion includes the second edge;

a sleeve attached along the fold location on an interior surface of the mattress gusset, the sleeve including an internal, coaxial passage sufficient to receive a drawstring having sufficient length to impart opposing open ends thereof;

a drawstring slideably disposed within the passage of the sleeve, wherein a first end and a second end of the drawstring extend from respective opposing open ends of the sleeve a sufficient distance to allow the first and second ends of the drawstring to be pulled in tension and coupled together, and wherein the drawstring includes one or more of a string, a rope, a cord, a wire, a monofilament, elastic, or elastomeric monofilament.

6. The self-forming mattress cover of claim 5, wherein the first and second ends of the drawstring are pulled to induce tension in the drawstring, thereby drawing the fold location of the mattress gusset inward away from the border, and the first and second ends of the drawstring are secured to maintain the tension.

7. The self-forming mattress cover of claim 6, wherein the first and second ends of the drawstring are secured by one or more of tying, clamping, sewing, and fastening in place.

8. The self-forming mattress cover of claim 6, wherein the mattress gusset stretches at corner positions of the mattress, such that no ruffles, miters, pleats, or seams are necessary to conform the gusset to the corner positions.

9. The self-forming mattress cover of claim 5, wherein the drawstring includes an elastomeric monofilament.

10. The self-forming mattress cover of claim 5, wherein the sleeve is attached to the mattress gusset by one or more of sewing, adhesives, and fasteners.

11. A method for manufacturing a self-forming mattress cover, wherein a cushioned quilt is attached to a mattress using a gusset with a drawstring, and wherein the gusset conforms to corner positions of the mattress and ensures proper alignment between the mattress and the cushioned quilt, the method comprising:

attaching a first edge of the gusset to a mattress border, the gusset including, a fold location bisecting the length of the gusset into a first portion having the first edge, and a second portion having a second edge, a sleeve attached to the gusset along the fold location and having sufficient length to impart opposing open ends of the sleeve, and a drawstring slideably disposed within the sleeve and having a pair of ends extending respectively from the opposing open ends of the sleeve, the drawstring including one or more of a string, a rope, a cord, a wire, a monofilament, elastic, or elastomeric monofilament;

inducing tension in the drawstring via the pair of ends of the drawstring, thereby drawing the fold location of the gusset inward away from the mattress border;

securing the pair of ends of the drawstring to maintain tension;

folding the gusset at the fold location such that the second portion lies above the first portion;

attaching the cushioned quilt to the gusset along the second edge.

12. The method of clam 11, wherein tension is imparted in the drawstring manually.

13. The method of claim 11, wherein tension is imparted in the drawstring by a machine.

14. The method of claim 11, wherein the sleeve is attached to the gusset by one or more of stitching, adhesives, and fasteners.

15. The method of claim 11, wherein the pair of ends are secured by one or more of tying, clamping, sewing, and fastening in place.

16. The method of claim 11, wherein the cushioned quilt is one of a pillow-top, Euro-top, and box-top.

17. The method of claim 11, where inducing tension in the drawstring stretches the gusset at the corner positions.

18. The method of claim 11, wherein no ruffles, miters, pleats, or seams are necessary to conform the gusset to the corner positions.

* * * * *